US009485571B2

(12) United States Patent
Yoo

(10) Patent No.: US 9,485,571 B2
(45) Date of Patent: Nov. 1, 2016

(54) MICROPHONE MANUFACTURING METHOD, MICROPHONE, AND CONTROL METHOD

(71) Applicant: Hyundai Motor Company, Seoul (KR)

(72) Inventor: Ilseon Yoo, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/798,716

(22) Filed: Jul. 14, 2015

(65) Prior Publication Data

US 2016/0157012 A1 Jun. 2, 2016

(30) Foreign Application Priority Data

Nov. 28, 2014 (KR) ..... 10-2014-0169044

(51) Int. Cl.
*H04R 9/08* (2006.01)
*H04R 3/00* (2006.01)
*H04R 31/00* (2006.01)

(52) U.S. Cl.
CPC ..... *H04R 3/00* (2013.01); *H04R 31/00* (2013.01)

(58) Field of Classification Search
CPC ..... H04R 3/00; H04R 31/00
See application file for complete search history.

(56) References Cited

U.S. PATENT DOCUMENTS

2014/0355784 A1* 12/2014 Han ..... H04R 1/406 381/92

FOREIGN PATENT DOCUMENTS

| | | | |
|---|---|---|---|
| JP | 3862628 | B2 | 12/2006 |
| KR | 200405367 | * | 12/2004 |
| KR | 10-0631285 | B1 | 10/2006 |
| KR | 10-0640199 | B1 | 11/2006 |
| KR | 10-0740462 | B1 | 7/2007 |

* cited by examiner

*Primary Examiner* — Tuan D Nguyen
(74) *Attorney, Agent, or Firm* — Mintz Levin Cohn Ferris Glovsky and Popeo, P.C.; Peter F. Corless

(57) ABSTRACT

A method of manufacturing a microphone, a microphone, and a method of controlling the microphone are provided. The method includes forming a sound sensing module on a mainboard having a first sound aperture, to be connected with the first sound aperature and forming a cover having a second sound aperature that corresponds to the first sound aperature, mounted on the mainboard, and housing the sound sensing module. A first and second sound delay filters are formed in a space defined by the cover, to be connected with the second sound hole and thermal actuators are disposed at both sides of the first sound delay filter and move the first sound delay filter based on whether power is supplied. A semiconductor chip is electrically connected with the sound sensing module in the space and selectively operates the thermal actuators in response to signals from the sound sensing module.

7 Claims, 6 Drawing Sheets

FIG. 2A
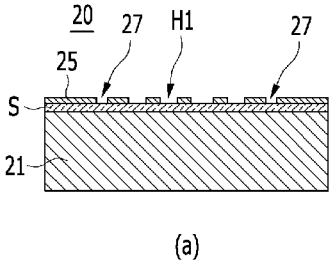
FIG. 2B
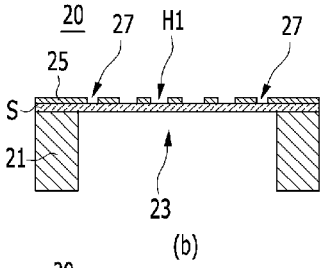
FIG. 2C
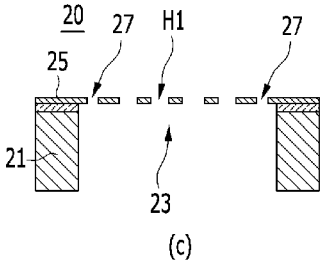
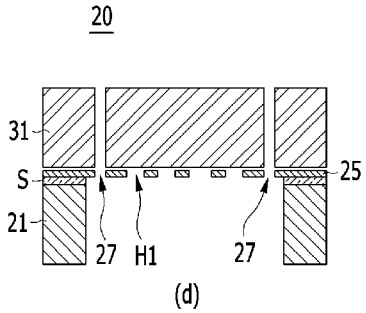
FIG. 2D
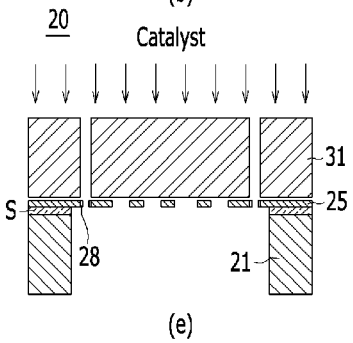
FIG. 2E
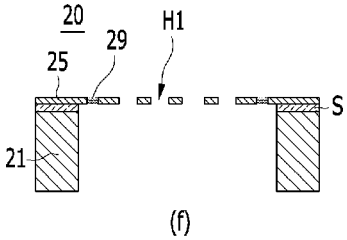
FIG. 2F FIG. 3A
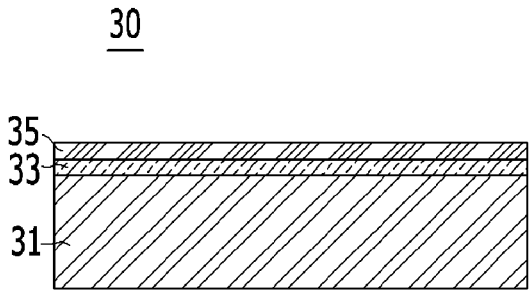
(g)
FIG. 3B
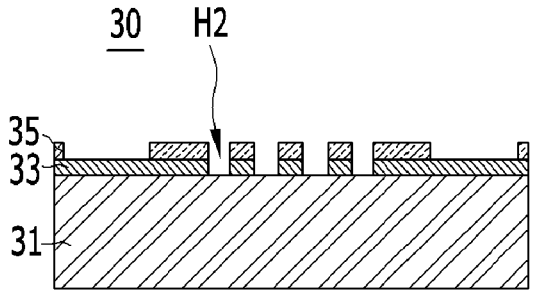
(h)
FIG. 3C
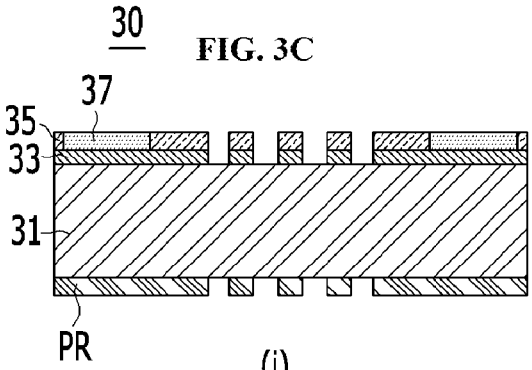
(i)
FIG. 3D
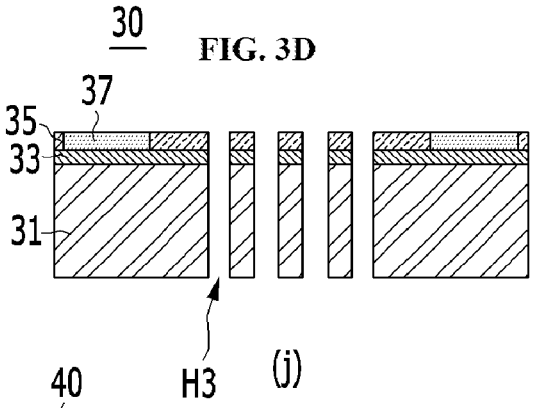
(j)
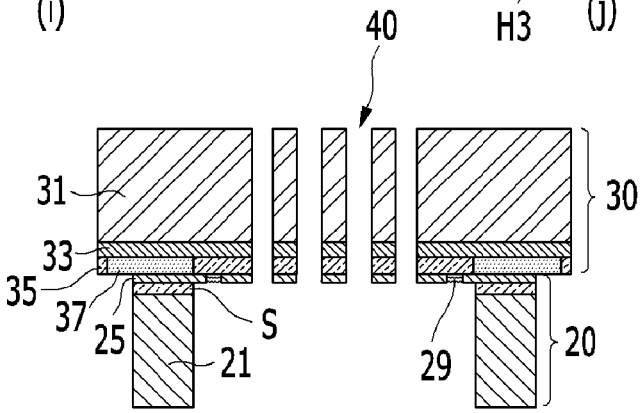
(k)
FIG. 3E FIG. 6A
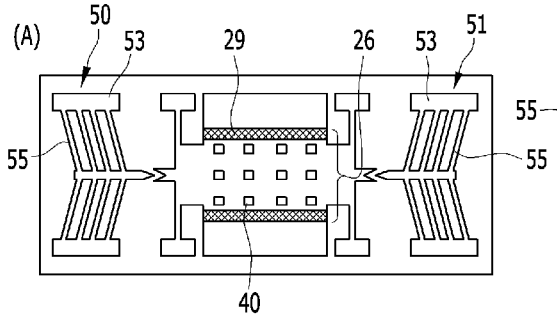
FIG. 6B
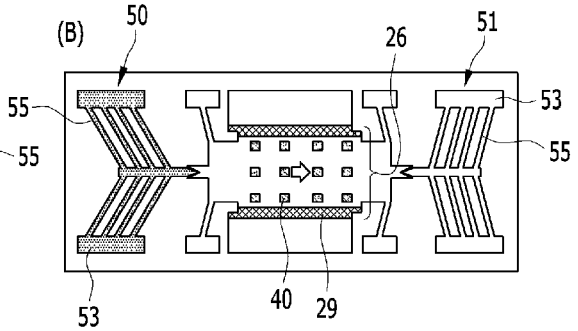
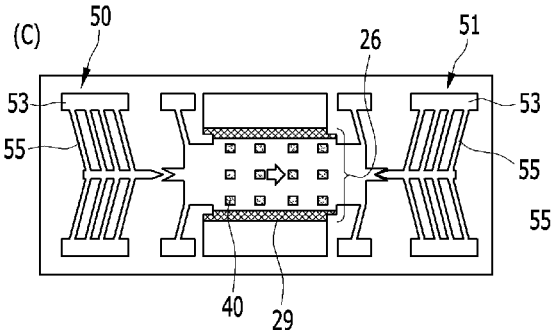
FIG. 6C
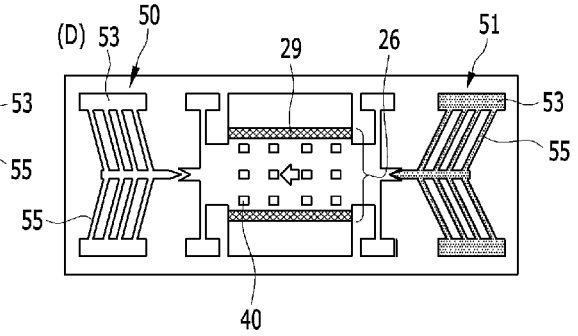
FIG. 6D

MICROPHONE MANUFACTURING METHOD, MICROPHONE, AND CONTROL METHOD

CROSS-REFERENCE TO RELATED APPLICATION

This application claims priority to and the benefit of Korean Patent Application No. 10-2014-0169044 filed in the Korean Intellectual Property Office on Nov. 28, 2014, the entire contents of which are incorporated herein by reference.

BACKGROUND (a) Field of the Invention

The present invention relates to a microphone, a method of manufacturing a microphone, and a method of controlling the microphone. More particularly to a method of manufacturing a microphone which selectively implements directional characteristics of a microphone, based on noisy environments, a microphone, and a method of controlling the microphone.

(b) Description of the Related Art

In general, a microphone is a device configured to convert sound into an electrical signal. The microphone may be used for mobile communication devices including a terminal, and various communication devices including an earphone or a hearing aid. The microphone requires high audio performance, reliability, and operability. A capacitive microphone based on Micro Electro Mechanical System (MEMS) has high audio performance, reliability, and operability, as compared with an electret condenser microphone (ECM microphone).

The MEMS microphone is classified into a non-directional (omnidirectional) microphone and a directional microphone, based on the directional characteristics. The non-directional microphone has substantially uniform sensitivity for incident sound waves in all directions. Conversly, the directional microphone has different sensitivity based on the directions of incident sound waves, and is classified into a unidirectional type and a bidirectional type in accordance with the directional characteristics. For example, the directional microphone is used for recording in a narrow room or capturing only desired sounds in a room with numerousreverberations.

When the microphones are mounted within a vehicle, sound sources are distance therefrom and noise is variably generated due to the environmental characteristics of the vehicle, and thus there is a need for a microphone that is functional in the noisy environment in the interior of the vehicle. The directional MEMS microphone captures sounds only in the desired directions. However, since the directional microphone of the related art captures sounds only in desired directions, it is functional against surrounding noise, but the sensitivity is low and the frequency response characteristic are poor compared with the non-directional microphone.

The above information disclosed in this section is merely for enhancement of understanding of the background of the invention and therefore it may contain information that does not form the prior art that is already known in this country to a person of ordinary skill in the art.

SUMMARY

The present invention provides a method of manufacturing a microphone having advantages of being suitable for an environment with variable noise, a microphone, and a method of controlling the microphone.

An exemplary embodiment of the present invention provides a method of manufacturing a microphone, that may include: forming a sound sensing module on a mainboard having a first sound aperture, to be connected with the first sound aperture; forming a cover having a second sound aperture that corresponds to the first sound aperture, mounted on the mainboard, and housing the sound sensing module; forming first and second sound delay filters in a space defined by the cover, to be connected with the second sound aperture; forming thermal actuators disposed at both sides of the first sound delay filter and moving the first sound delay filter in accordance with whether power is supplied; and forming a semiconductor chip electrically connected with the sound sensing module in the space and selectively operating the thermal actuators in response to signals from the sound sensing module.

The forming of a first sound delay filter may include: forming a sacrificial layer and a driving membrane on the front surface of the first substrate and then forming a plurality of coupling apertures and a plurality of first apertures by etching the driving membrane. Then a groove may be formed by etching the bottom of the first substrate and removing the sacrificial layer on the front surface of the first substrate; forming a photosensitive pattern on the driving membrane and then depositing a catalyst into the coupling apertures of the driving membrane using the photosensitive pattern as a mask; and depositing a coupling material to the catalyst.

The depositing of a catalyst may include a catalyst made of iron (Fe). Additionally, the depositing of a coupling material may include a coupling material made of carbon nanotubes (CNT). The forming of a plurality of coupling apertures and a plurality of penetration apertures through the driving membrane may form two side sections by a coupling material in the coupling apertures and form a center section having the first penetration apertures separated from the side sections. The center section may be movable by the thermal actuators.

The forming of a second sound delay filter may include: forming an oxide film and a bonding layer on a side of the second substrate; forming a photosensitive pattern on the bonding layer and then forming a plurality of second penetration apertures by etching the oxide film and the bonding layer. The photosensitive pattern may be used as a mask; forming a plurality of metal pads on an etched side of the bonding laye and thenforming a photosensitive pattern on the other side of the second substrate. A plurality of third penetration apertures may be formed by etching the second substrate, using the photosensitive pattern as a mask; and bonding to the driving membrane of the first sound delay filter through the metal pads. The forming of a bonding layer may include a bonding layer made of Si3N4. The first to third penetration apertures may be connected to each other and form a plurality of sound delay apertures as many as the numbers of the penetration apertures.

An exemplary embodiment of the present invention provides a microphone including: a sound sensing module may be mounted on a side of a mainboard having a first sound aperture.and is connectedmay be configured tothe first sound aperture. A cover that has a second sound aperture corresponding to the first sound aperture, may be mounted on the mainboard, and may have a space receiving the sound sensing module. A first sound delay filter may be disposed in the space. A second sound delay filter may be bonded to the top of the first sound delay filter by metal pads and may be configured to the second sound aperture in the cover. A plurality of thermal actuators that maybe disposed at both sides of the first sound delay filter and move the first sound delay filter a semiconductor chip may be electrically configured to the sound sensing module in the space and selectively operates the thermal actuators in response to signals from the sound sensing module.

The first sound delay filter may include: a first substrate having a groove; and a driving membrane may be disposed on the first substrate. The driving membrane may have a plurality of coupling apertures and a plurality of penetration apertures, and may have a center section divided to have the first penetration apertures formed by a coupling material deposited in the coupling apertures. The second sound delay filter may include: a second substrate that has a plurality of third penetration apertures; an oxide film and a bonding layer that maybe disposed on the second substrate and have a plurality of second penetration apertures; and metal pads that maybe disposed on the bonding layer.

The first to third penetration apertures may be configured to each other and form a plurality of sound delay apertures of as many as the number of penetration apertures. The second sound delay filter may be turned over and then bonded to the first sound delay filter by the metal pads on the top of the second sound delay filter. The thermal actuator may include a first thermal actuator and a second thermal actuator, may be disposed at both sides of the first sound delay filter, and may move the center section using an extending force generated when a current is supplied.

Another exemplary embodiment of the present invention provides a method of controlling a microphone, including: operating a sound sensing module via a sound processor; transmitting a sound voltage generated by the sound sensing module to a semiconductor chip; measuring the magnitude of a noise voltage from the sound voltage input to the semiconductor chip, and determining whether the measured noise voltage may be under a predetermined reference voltage; and implementing a non-directional microphone by moving a center section of a first sound delay filter by means of a first thermal actuator to close sound delay apertures, when the noise voltage may be under the reference voltage.

In the implementing of a non-directional microphone, when the semiconductor chip supplies a current to the first thermal actuator, the first thermal actuator may be configured to generate an extending force. The center section of the first sound delay filter may be moved by the extending force.

The implementing of a non-directional microphone may further include implementing a directional microphone by supplying a current to the second thermal actuator by the semiconductor chip, when the center section of the first sound delay filter may be moved by a second thermal actuator and the sound delay apertures maybe closed, when the noise voltage may be over the reference voltage. The first sound delay filter may be configured to maintain the state by a friction force of a coupling material on the first sound delay filter, even when a current is not continuously supplied.

According to an exemplary embodiment of the present invention, by the sound delay filters that may selectively operate a microphone of a non-directional type and a directional type, it may be possible to implement a non-directional microphone and a directional microphone based on environments with variable noise.

Further, since it may be possible to maintain the directional types even when power is not continuously supplied, it may be possible to minimize power consumption. In addition, correction of the directional types may be in accordance with packaging errors, making it advantageous in terms of a yield ratio and manufacturing cost. The sound delay filters may have a low performance differences and maybe driven by static electricity. Power consumption may be substantially low, and the manufacturing cost may be reduced.

Effects that may be obtained or expected from exemplary embodiments of the present invention maybe directly or suggestively described in the following detailed description. For example, various effects expected from exemplary embodiments of the present invention will be described in the following detailed description.

BRIEF DESCRIPTION OF THE DRAWINGS

The above and other objects, features and advantages of the present disclosure will be more apparent from the following detailed description taken in conjunction with the accompanying drawings.

FIGS. 2A-2F are exemplary embodiments of schematic diagrams illustrating a process of manufacturing a first sound delay filter of a microphone according to an exemplary embodiment of the present invention;

FIGS. 3A-3E are exemplary embodiment of schematic diagrams illustrating a process of manufacturing a second sound delay filter of a microphone according to an exemplary embodiment of the present invention;

FIGS. 6A-6D .are exemplary embodiments of a schematic diagrams illustrating a method of activating sound delay filters of a microphone according to an exemplary embodiment of the present invention.

DETAILED DESCRIPTION OF THE EMBODIMENTS

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, In order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

An exemplary embodiment of the present invention will hereinafter be described in detail with reference to the accompanying drawings. However, the drawings to be described below and the following detailed description relate to one preferred exemplary embodiment of various exemplary embodiments for effectively explaining the characteristics of the present invention. Therefore, the present invention should not be construed as being limited to the drawings and the following description.

Further, in the description of the present invention, the detailed description of related well-known configurations and functions is not provided, when it is determined as unnecessarily making the scope of the present invention unclear. In addition, the terminologies to be described below are ones defined in consideration of their function in the present invention, and may be changed by the intention of a user, an operator, or a custom. Therefore, their definition should be determined on the basis of the description of the present invention.

Further, in the following exemplary embodiments, the terminologies are appropriately changed, combined, or divided so that those skilled in the art may clearly understand them, in order to efficiently explain the main technical characteristics of the present invention, but the present invention is not limited thereto.

Figure 1:
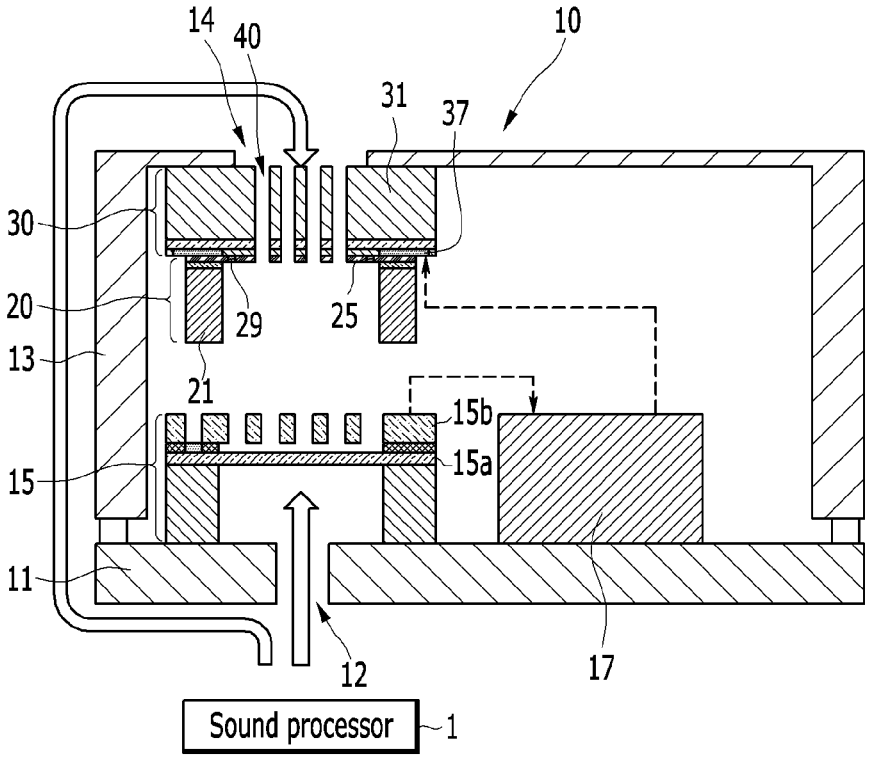
FIG. 1 is an exemplary embodiment of a schematic diagram illustrating the configuration of a microphone according to a first exemplary embodiment of the present invention.

FIG. 1 is an exemplary schematic diagram illustrating the configuration of a microphone according to a first exemplary embodiment of the present invention. Referring to FIG. 1, a microphone 10 according to a first exemplary embodiment of the present invention may include a mainboard 11, a cover 13, a sound sensing module 15, a first sound delay filter 20, a second sound delay filter 30, thermal actuators 50 and 51 (see FIG. 6), and a semiconductor chip 17. The mainboard 11 has a first sound aperture 12 and may be a PCB. The first sound aperture 12 is a passage through which sound from a sound processor 1 flows. The sound processor 1, which processes a voice of a user, may be at least one of a speech recognition device, a hands-free device, and a portable communication terminal. When a user provides an order by voice, the speech recognition device recognizes the voice and performs the order from the user.

The hands-free device may be configured to the portable communication terminals through local wireless communication, so that users may freely speak without the portable communication terminal in their hands The portable communication terminal, which may perform wireless phone calls, may be a smart phone or a PDA (Personal Digital Assistant). The cover 13 may be mounted on the mainboard 11. The cover 13 may have a second sound aperture 14 corresponding to the first sound aperture 12, and may have a space over the mainboard 11. The second sound aperture 14, may be similar to the first sound aperture 12, may bea passage through which sound from the sound processor 1 flows. The cover 13 may be made of a metal. The sound sensing module 15 may be disposed in the space over the mainboard 11 and configured to the first sound aperture 12. The sound sensing module 15 may sense sound from the sound processor 1. For example, the sound sensing module 15 senses sound from the sound processor 1 and may use a vibrating membrane 15*a* and a fixed membrane 15*b*. The sound sensing module 15 may output a sensing signal to the semiconductor chip 17. The sound sensing module 15 may be implemented by a non-directional microphone. The non-directional microphone may be achieved on the basis of the MEMS (Micro Electro Mechanical System).

The sound delay filters 20 and 30 may be disposed in the space defined by the cover 13. Although the sound delay filters 20 and 30 may be positioned above the sound sensing module 15 in an exemplary embodiment of the present invention, their positions may be changed as necessary. The sound delay filters 20 and 30 may be configured to the second sound aperture 14 of the cover 13. The sound delay filters 20 and 30 may be a first sound delay filter 20 and a second sound delay filter 30. The first sound delay filter 20 may be composed of a first substrate 21 and a driving membrane 25. The first substrate 21 may have a groove 23 (see FIG. 2) on the bottom and may be at least one of a silicon wafer and an SOI (silicon on insulator) wafer. The driving membrane 25 may be supported and fixed by a sacrificial layer S (see FIG. 2) on the first substrate 21.

The driving membrane 25 may have a plurality of coupling apertures 27 (see FIG. 2) and a plurality of first penetration apertures H1 (see FIG. 2). Although the coupling apertures 27 may be formed at two predetermined positions to divide the driving membrane 25 into three sections in this exemplary embodiment, the present invention is not limited thereto, and the number of coupling apertures 27 may be changed as necessary. In detail, the driving membrane 25 may have two coupling apertures 27 and the plurality of first penetration apertures H1, and the two coupling apertures 27 may be formed around both edges of the driving membrane 25 so the driving membrane 25 may be divided into three sections.

The three sections are two side sections without the first penetration apertures H1 and a center section 26 (see FIG. 6) with the first penetration apertures H1. In other words, the center section 26 may be positioned between the two coupling apertures 27. The coupling apertures 27 may be filled with a coupling material 29, and the coupling material 29 may be carbon nanotubes (CNT). The CNT, which may be a material having excellent electrical and thermal conductivity, may be a high-strength and high-elasticity fibrous material having a large aspect ratio. The second sound delay filter 30 may be composed of a second substrate 31 and a bonding layer 35 (see FIG. 3) having a metal pad 37. The second substrate 31 may have a plurality of third penetration apertures H3 (see FIG. 3) and may be made of silicon.

The bonding layer 35 and the second substrate 31 may be formed with an oxide film 33 (see FIG. 3) therebetween. Second penetration apertures H2 may be formed such that the bonding layer 35 and the oxide film 33 are configured to the third penetration apertures H3. A predetermined side of the bonding layer 35 may be etched and metal pads 37 are attached to the side.

The oxide film 33 may be made of $SiO_2$ and the bonding layer 35 may be made of $Si_3N_4$. The second sound delay filter 30, may be manufactured as described above, is turned over and then bonded to the first sound delay filter 20 by the metal pads 37 in the bonding layer 35. The first to third penetration apertures H1, H2, and H3 are aligned, thereby forming a plurality of sound delay apertures 40. The number of sound delay apertures 40 may be as many as there are first to third penetration apertures H1, H2, and H3. The sound delay apertures 40 may be configured to the second sound aperture 14.

The thermal actuators 50 and 51 may be a first thermal actuator 50 and a second thermal actuator 51. Describing the thermal actuators 50 and 51 in detail, a thermal wire pattern 55 (see FIGS. 6A-6D) made of silicon or polysilicon may be disposed, and when a voltage is applied to the thermal wire pattern 55, a current may flow and heat may be generated. The thermal wire pattern 55 may generate a driving force while being expanded by heat. The thermal actuators 50 and 51 may be disposed at both sides of the first sound delay filter 20 and move the first sound delay filter 20. In other words, the thermal actuators 50 and 51 may each be composed of a fixed driving electrode pad 53 (see FIGS. 6A-6D) and the thermal wire pattern 55 configured to the driving electrode pad 53, and may be disposed at both sides of the driving membrane 25 of the first sound delay filter 20. For example, the thermal actuators 50 and 51 may be disposed at both sides of the center section 26 defined by the coupling material 29 in the driving membrane 25 and selectively move the center section 26. As the center section 26 is moved, the sound delay apertures 40 change in area, and accordingly, the directional characteristic of the microphone 10 may change More detailed description will be provided below with reference to FIGS. 6A-6D. The semiconductor chip 17 may be electrically configured to the sound sensing module 15 and may selectively operate the thermal actuators 50 and 51 in response to signals from the sound sensing module 15. For example, the semiconductor chip 17 is configured to a sound voltage from the sound sensing module 15 and may measure the magnitude of a noise voltage from the sound voltage. The semiconductor chip 17 may determine whether the magnitude of the noise voltage may be over a predetermined reference voltage, and may create a determination result. The reference voltage may show the magnitude of sound allowing a user to speak or recognize sound well. The reference voltage may be set by a user or a predetermined algorithm (e.g., a program and a probability model). The reference voltage may not fixed and may be changed, depending on circumstances. The semiconductor chip 17 may be an Application Specific Integrated Circuit (ASIC.

A method of manufacturing the microphone 10 is as follows. First, a step of forming the sound sensing module 15 on the mainboard 11 having the first sound aperture 12 may be configured to the first sound aperture 12 may be performed. Sound from the exterior sound processor 1 flows to the interior through the first sound aperture 12 and travels to the sound sensing module 15. Next, a step of mounting the cover 13 on the mainboard llmay be performed. The cover 13 may have the second sound aperture corresponding to the first sound aperture 12. The second sound aperture 14, similar to the first sound aperture 12,may be a passage through which sound from the exterior sound processor 1 flows. Next, steps of forming the first and second sound delay filters 20 and 30 configured to the second sound aperture 14 may be performed. A method of manufacturing the first and second sound delay filters 20 and 30 is as follows.

FIGS. 2A-2F and 3A-3E are exemplary embodiments of schematic diagrams illustrating processes of manufacturing the first and second sound delay filters of the microphone according to an exemplary embodiment. Referring to FIGS. 2A-2D, the first sound delay filter 20 of the microphone 10 may include, the sacrificial layer S and the driving membrane 25 formed on the front surface of the first substrate 21, as shown in (a) of FIG. 2A. Next, a step of forming the coupling apertures 27 and the first penetration apertures H1 by etching the driving membrane 25 may be performed. The coupling apertures 27 may be formed at two positions at both sides, respectively, of the driving membrane 25. The driving membrane 25 may be divided into two side sections without the first penetration apertures H1 and the center section 26 with the first penetration apertures H1 by the two coupling apertures 27. The driving membrane 25 may be made of any one of polysilicon and SOL Next, a step of forming the groove 23 by etching the bottom of the first substrate 21, as in (b) of FIG. 2B, and of removing a portion of the sacrificial layer S on the front surface of the first substrate 21, as in (c) of FIG. 2C, may be performed. Next, as in (d) of FIG. 2D, a photosensitive layer PR may be formed on the driving membrane 25 and then a photosensitive pattern may be formed by patterning the photosensitive layer PR. Next, as in (e) of FIG. 2E, a step of depositing a catalyst 28 into the coupling apertures 27 of the driving membrane 25, using the photosensitive pattern as a mask, may be performed. The catalyst 28 may contain iron (Fe). Next, as in (f) of FIG. 2F a step of depositing the coupling material 29 to the catalyst 28 may be performed. The coupling material 29 may contain CNT.

Referring to FIGS. 3A-3E, the second sound delay filter 30 of the microphone 10 may include, a step of forming the oxide film 33 and the bonding layer 35 on a side of the second substrate 31, as in (g) of FIG. 3A, may be performed. The oxide film 33 may contain SiO2 and the bonding layer 35 may contain Si3N4. Next, a photosensitive layer PR may be formed on the bonding layer 35 and then a photosensitive pattern may be formed by patterning the photosensitive layer PR. A step of forming the second penetration apertures H2 by etching the oxide film 33 and the bonding layer 35, using the photosensitive pattern as a mask, as in (h) of FIG. 3B may be performed.

A process of forming pad grooves for depositing the metal pads 37 by etching a side and the other side of the bonding layer 35 may be performed. Next, as in (i) of FIG. 3C, a step of depositing the metal pad 37 to a side and the other side of the bonding layer 35 may be performed. Subsequently, a photosensitive layer PR may be formed on the other side of the second substrate 31 and then a photosensitive pattern may be formed by patterning the photosensitive layer PR. As in (j) of FIG. 3D, a step of forming the third penetration apertures H3 by etching the second substrate 31, using the photosensitive pattern as a mask, may be performed.

Finally, as in (k) of FIG. 3E, a step of turning over the second sound delay filter 30 and then bonding it to the driving membrane 25 of the first sound delay filter 20 through the metal pads 37 on the second sound delay filter 30 may be performed. The bonding may be achieved by eutectic bonding. The eutectic bonding may be a type of bonding using the phenomenon in which the components of an alloy may be easily melted and bonded to each other at the lowermost melting point, when predetermined conditions such as a predetermined component ratio and a predetermined temperature are satisfied.

The first penetration apertures H1 of the first sound delay filter 20 and the second and third penetration apertures H2 and H3 of the second sound delay filter 30 may be configured to each other, thereby forming the sound delay apertures 40. The sound delay apertures 40 may be configuredto the second sound aperture 14.

After the step of forming the first and second sound delay filters 20 and 30, steps of forming the first thermal actuator 50 and the second thermal actuator 51 at both sides of the first sound delay filter 20 may be performed. The thermal actuators 50 and 51 may be arranged to be able to move the center section 26 of the driving membrane 25 of the first sound delay filter 20, depending on whether power is applied. Next, a step of forming the semiconductor chip 17 electrically configured to the sound sensing module 15 may be performed. The semiconductor chip 17 may selectively operate the thermal actuators 50 and 51 in response to signals from the sound sensing module 15.

Figure 4:
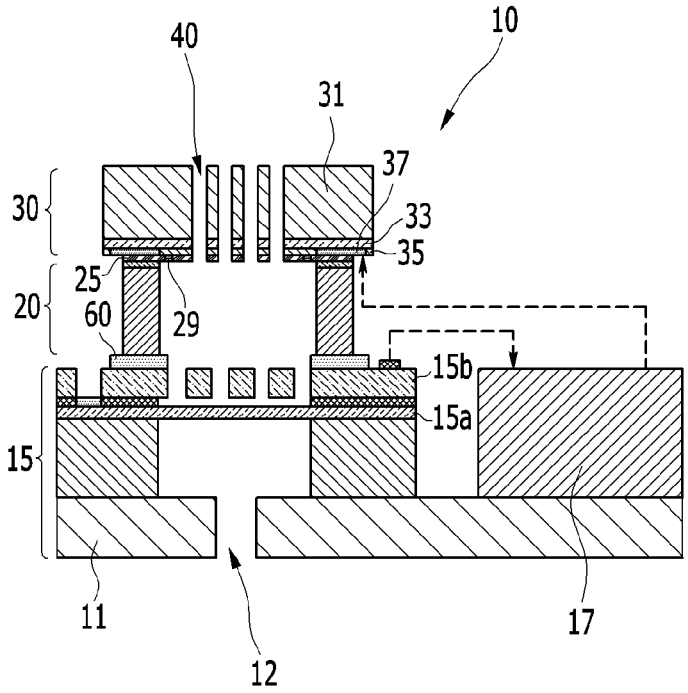
FIG. 4 is an exemplary embodiment of a schematic diagram illustrating the configuration of a microphone according to a second exemplary embodiment of the present invention.

FIG. 4 is an exemplary schematic diagram illustrating the configuration of a microphone according to a second exemplary embodiment of the present invention. Referring to FIG. 4, the positions of the sound delay filters 20 and 30 based on the configuration shown in FIG. 1 may be changed.

Further, it may be manufactured through simple processes by removing the cover 13 shown in FIG. 1.

In detail, the sound sensing module 15 may be mounted on the mainboard 11 having the first sound aperture 12 configuredto the first sound aperture 12. The sound delay filters 20 and 30 may be disposed over the sound sensing module 15, with a bonding pad 60 therebetween. The bonding pad 60 may be provided for eutectic bonding of the sound sensing module 15 and the sound delay filters 20 and 30. In other words, the bonding pad 60, which is made of a metal, may be attached in order to bond the sound sensing module 15 and the sound delay filters 20 and 30, and they may be bonded by the bonding pad 60 through eutectic bonding.

Except for those described above, the configuration and manufacturing method of the microphone 10 according to the second exemplary embodiment of the present invention are the same those of the microphone shown in FIG. 1, therefore they are not described in detail.

Figure 5:
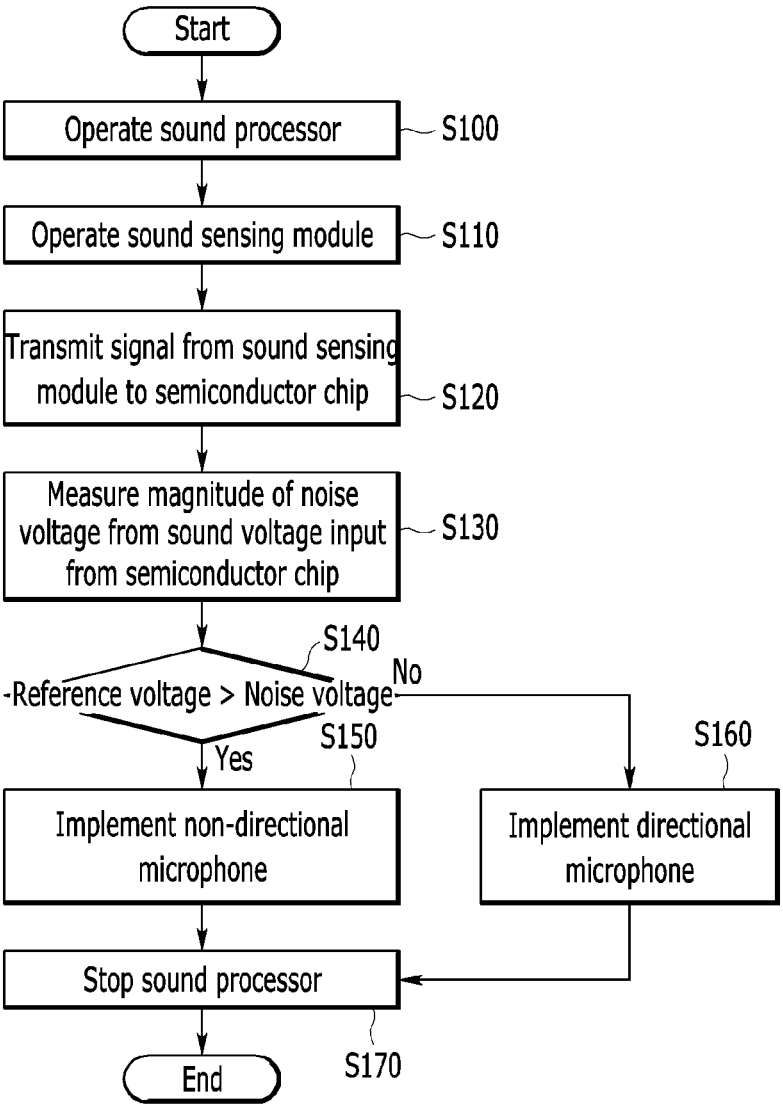
FIG. 5 is an exemplary embodiment of a flowchart illustrating a method of controlling a microphone according to an exemplary embodiment of the present invention.

FIG. 5 is an exemplary flowchart illustrating a method of controlling a microphone according to an exemplary embodiment of the present invention. Referring to FIG. 5, a sound processor 1 may start to operate. The sound processor 1, which processes a voice of a user, may be at least one of a speech recognition device, a hands-free device, and a portable communication terminal. As the sound processor 1 starts to operate, the sound sensing module 15 may operate. The sound sensing module 15 may transmit a sound voltage, which may be input from the sound processor 1, to a semiconductor chip 17. The semiconductor chip 17 may measure the magnitude of a noise voltage from the sound voltage input from the sound sensing module 15. The semiconductor chip 17 may compare the noise voltage with a predetermined reference voltage. The semiconductor chip 17may measure the magnitude of a noise voltage from the sound voltage input from the sound sensing module 15.

When the noise voltage is under the reference voltage, the semiconductor chip 17 may move the center section 26 of the first sound delay filter 20, using the first thermal actuator 50, to close the sound delay apertureapertures 40 and the microphone 10 may be implemented as a non-directional type. When the noise voltage becomes greater than the reference voltage, the semiconductor chip 17 may return the center section 26 of the first sound delay filter 20 to the initial position, using the second thermal actuator 51, opening the sound delay apertures 40 and the microphone 10 may be implemented as a directional type. Finally, the sound processor lmay be stopped.

The operation of the sound delay filters may be described in more detail with reference to FIGS. FIGS. 6A-6D are an exemplary schematic diagram illustrating a method of activating sound delay filters of a microphone according to an exemplary embodiment of the present invention. Referring to FIG. 6, the sound delay filters 20 and 30 are operated by the first thermal actuator 50 and the second thermal actuator 51 disposed at their both sides. The sound delay filters 20 and 30 are selectively implemented as a directional type and a non-directional type, depending on signals from the semiconductor chip 17. (A) of FIG. 6A shows the initial state of the sound delay filters 20 and 30.

The semiconductor chip 17 may compare a noise voltage input from the sound sensing module 15 with a predetermined reference voltage, and when the noise voltage is under the reference voltage, it may supply a current to the first thermal actuator 50. As a current is supplied to the first thermal actuator 50, the thermal wire pattern 50 may extend and generate a driving force, so that, as in (B) of FIG. 6B, it moves the center section 26 of the first sound delay filter 20 to the second thermal actuator 51. Therefore, the sound delay apertures 40 may be closed and the microphone 10 may be implemented in a non-directional type.

Conversley, even when a current from the semiconductor chip 17 is cut, the sound delay filters 20 and 30 may keep their states via a friction force of the coupling material 29 on the first sound delay filter 20 even without continuous supply of a current, therefore power consumption is minimized. Further, when the noise voltage input from the sound sensing module 15 is greater than the predetermined reference voltage, the semiconductor chip 17 may supply a current to the second thermal actuator 51. As a current is supplied to the second thermal actuator 51, the thermal wire pattern 51 may extend and generate a driving force, so that, as in (B) of FIG. 6B, it returns the center section 26 of the first sound delay filter 20 to the initial position by moving it back to the first thermal actuator 50.

Therefore, the sound delay apertures 40 of the sound delay filters 20 and 30 may be opened and the microphone may be implemented as a direction type. Therefore, the microphone 10 according to an exemplary embodiment of the present invention may be selectively implemented as a non-directional type and a directional type and the directional types may be maintained even when a current stops being supplied, after the sound delay filters 20 and 30 are operated to achieve the directional types, such that it is possible to minimize power consumption.

While this invention has been described in connection with what is presently considered to be practical exemplary embodiments, it is to be understood that the invention is not limited to the disclosed exemplary embodiments, but, on the contrary, is intended to cover various modifications and equivalent arrangements included within the spirit and scope of the appended claims.

DESCRIPTION OF SYMBOLS

1 . . . Sound processor
10 . . . Microphone
11 . . . Mainboard
12 . . . First sound aperture
13 . . . Cover
14 . . . Second sound aperture
15 . . . Sound sensing module
15*a* . . . Vibrating membrane
15*b* . . . Fixed membrane
17 . . . Semiconductor chip
20 . . . First sound delay filter
21 . . . First substrate
23 . . . Groove
25 . . . Driving membrane
26 . . . Center section
27 . . . Coupling aperture
28 . . . Catalyst
29 . . . Coupling material
30 . . . Second sound delay filter
31 . . . Second substrate
33 . . . Oxide film
35 . . . Bonding layer
37. . . Metal pad
40 . . . Sound delay aperture
50 . . . First thermal actuator
51 . . . Second thermal actuator
53 . . . Driving electrode pad
55 . . . Thermal wire pattern
60 . . . Bonding pad S . . . Sacrificial layer
H1 . . . First penetration aperture
H2 . . . Second penetration aperture
H3 . . . Third penetration aperture
PR . . . Photosensitive layer

What is claimed is:

1. A microphone comprising:

a sound sensing module mounted on a side of a mainboard having a first sound aperture and connected to the first sound aperture;

a cover that has a second sound aperture that corresponds to the first sound aperture, mounted on the mainboard, and has a space receiving the sound sensing module;

a first sound delay filter disposed in the space;

a second sound delay filter bonded to the top of the first sound delay filter by metal pads and is connected to the second sound aperture in the cover;

a plurality of thermal actuators disposed at both sides of the first sound delay filter and move the first sound delay filter; and a semiconductor chip electrically configured to the sound sensing module in the space and selectively operates the thermal actuators in response to signals from the sound sensing module.

2. The microphone of claim 1, wherein the first sound delay filter includes:

a first substrate having a groove; and a driving membrane disposed on the first substrate, has a plurality of coupling apertures and a plurality of penetration apertures, and has a center section divided to have the first penetration apertures formed by a coupling material deposited in the coupling apertures.

3. The microphone of claim 1, wherein the second sound delay filter includes:

a second substrate having a plurality of third penetration apertures;

an oxide film and a bonding layer disposed on the second substrate and having a plurality of second penetration apertures; and metal pads disposed on the bonding layer.

4. The microphone of claim 2, wherein the first to third penetration apertures are connected to each other and form a plurality of sound delay apertures of as many as the number of penetration apertures.

5. The microphone of claim 3, wherein the first to third penetration apertures are connected to each other and form a plurality of sound delay apertures of as many as the number of penetration apertures.

6. The microphone of claim 3, wherein the second sound delay filter is turned over and then bonded to the first sound delay filter by the metal pads on the top of the second sound delay filter.

7. The microphone of claim 1, wherein the thermal actuators include a first thermal actuator and a second thermal actuator, disposed at both sides of the first sound delay filter, and move the center section using an extending force generated when a current is supplied.

* * * * *